US005097737A

United States Patent [19]

Uhrig

[11] Patent Number: 5,097,737

[45] Date of Patent: Mar. 24, 1992

[54] TUNER SYSTEM FOR A STRINGED INSTRUMENT

[76] Inventor: Ira J. Uhrig, 4015 NW Ave., Bellingham, Wash. 98226

[21] Appl. No.: 455,557

[22] Filed: Dec. 18, 1989

[51] Int. Cl.[5] ..... G10D 3/06

[52] U.S. Cl. ..... 84/314 N

[58] Field of Search ..... 84/304, 307, 293, 297 R, 84/314 N, 454, 455

[56] References Cited

U.S. PATENT DOCUMENTS

| | | | |
|---|---|---|---|
| 2,364,861 | 12/1944 | McBride | 84/1.15 |
| 2,487,193 | 11/1949 | Smith | 84/312 |
| 2,504,752 | 4/1950 | Sullivan | 84/267 |
| 3,191,480 | 6/1965 | Lowe | 84/318 |
| 3,392,618 | 7/1968 | Pelensky . | |
| 4,078,468 | 3/1978 | Civitello | 84/297 R X |
| 4,171,661 | 10/1979 | Rose | 84/313 |
| 4,183,279 | 1/1980 | Shabram | 84/318 |
| 4,304,163 | 12/1981 | Siminoff | 84/314 N |
| 4,457,201 | 7/1984 | Storey | 84/313 |
| 4,497,236 | 2/1985 | Rose | 84/298 |
| 4,535,670 | 8/1985 | Borisoff | 84/312 |
| 4,643,069 | 2/1987 | Borisoff et al. | 84/306 |
| 4,693,161 | 9/1987 | Uhrig | 84/327 |

OTHER PUBLICATIONS

"The Nature of Necks," Frets Magazine, Mar. 1984, p. 60.

"Two Tuning Changers," Guitar Player, Jul. 1986, p. 109.

"Questions," Frets Magazine, Jan. 1982, p. 49.

"The Upright Bass," Frets Magazine, Apr. 1981, p. 52.

"It's Ugly But it Works," Frets Magazine, Nov. 1985, p. 51.

"Making Good Vibrations," Frets Magazine, Oct. 1985, p. 48.

Advertisement illustrating a string clasp for an extended string.

"Designing An 8-String Guitar," Frets Magazine, May 1987, pp. 46–49.

One sheet of seven photographs; one photograph illustrating a modified tuning head.

"Questions," Frets Magazine, Sep. 1986, p. 62.

"Patent Search," Guitar Player, Oct. 1982, p. 6.

Advertisement "A18-11 Asturias 11-String Guitar".

Advertisements "A10-10 Asturias 10-String Guitar" and A8-7 Asturias 7-String Guitar.

Advertisement postcard for a tuner accessory sold under the trademark "Fat Head".

*Primary Examiner*—L. T. Hix

*Assistant Examiner*—Howard B. Blankenship

*Attorney, Agent, or Firm*—Cassidy, Vance & Tarleton

[57] ABSTRACT

A tuner apparatus and methods for use thereof for harmonically tuning a variety of stringed instruments. More particularly, an apparatus and methods which provide a guitar or other chordophone with an alternative or supplemental nut secured to the headstock of the instrument, without requiring permanent modification or defacement of the instrument's structure. The supplemental nut is positioned to raise a particular string from a preexisting nut, thereby extending the effective scale length of the string. Alternative use of the supplemental nut and the preexisting nut allows the musician to selectively increase and decrease the effective scale length of the string to obtain a variation of sound. Thus, this invention enables the generation of deeper or lower notes on preexisting strings than would otherwise be available on such an instrument. In addition, the apparatus and methods allow a musician to alternate between two or more preselected scale lengths, in an easy and rapid fashion, without requiring careful or critical attention to manually fine tune each note after selection. The apparatus and methods also: allow the musician to play a variation of chords having different bass notes without having to significantly rethink fingering placement; improve the amplitude and sustain of the instrument; and prevent the longitudinal displacement of the string with respect to the nut on an electric guitar when a tremolo device is used.

19 Claims, 6 Drawing Sheets

FIG. 9
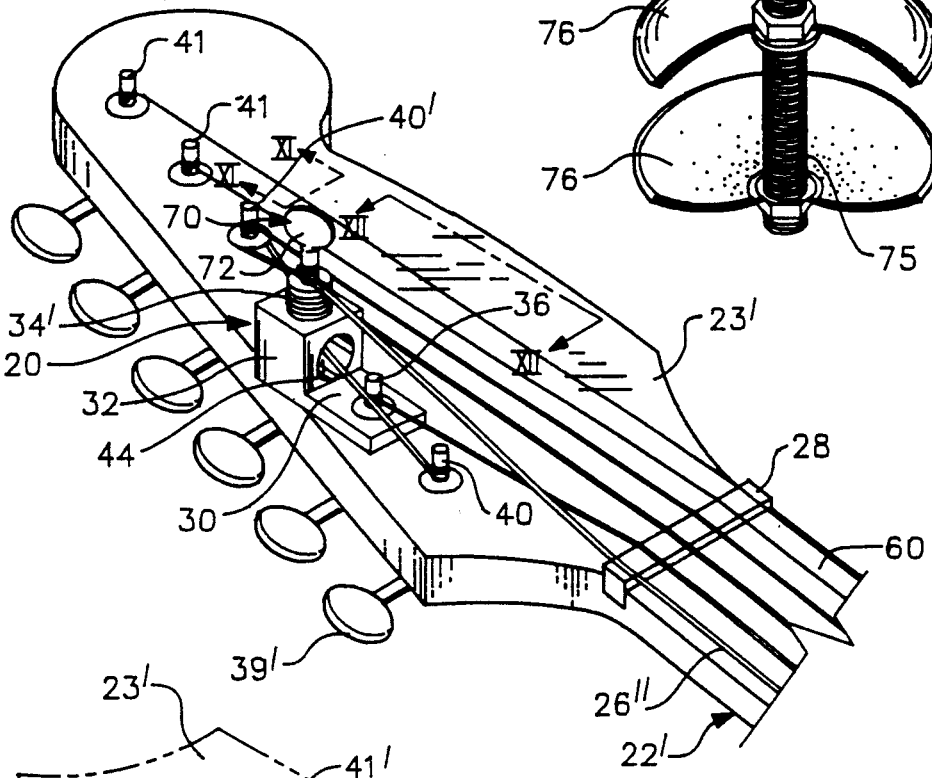
FIG. 13
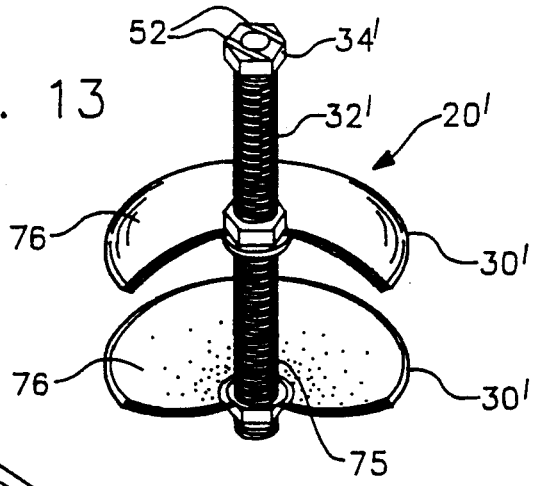
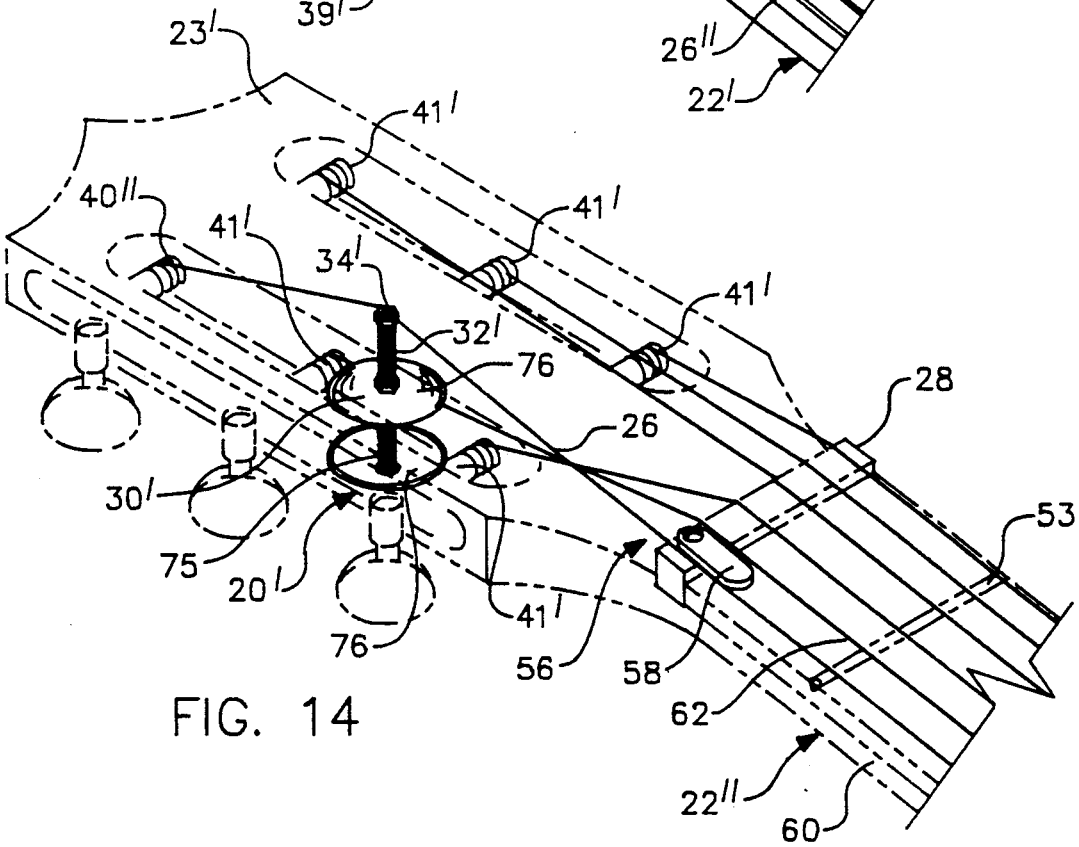
FIG. 14

TUNER SYSTEM FOR A STRINGED INSTRUMENT

TECHNICAL FIELD

The present invention relates to apparatus and methods for tuning a stringed musical instrument. More particularly, this invention relates to apparatus and methods for selectively extending and shortening the effective scale length of a string on a guitar or other chordophone to obtain a variation of sound, without requiring permanent modification of the instrument's structure.

BACKGROUND ART

There are two basic methods of tuning a stringed instrument. The first method is referred to as pitch or fine tuning. Pitch tuning is accomplished by increasing or decreasing the tension on a given string by means of using tuning heads, tuning keys, or the like. An increase in tension raises the pitch of the string. A decrease in tension lowers the pitch of the string. The following disclosures relate to various pitch tuning methods and devices: Borisoff et al. (U.S. Pat. No. 4,643,069; issued Feb. 17, 1987); Borisoff (U.S. Pat. No. 4,535,670; issued Aug. 20, 1985); Rose (U.S. Pat. No. 4,497,236; issued Feb. 5, 1985); Storey (U.S. Pat. No. 4,457,201; issued July 3, 1984); Rose (U.S. Pat. No. 4,171,661; issued Oct. 23, 1979); Sullivan (U.S. Pat. No. 2,504,752; issued Apr. 18, 1950); and Smith (U.S. Pat. No. 2,487,193; issued Nov. 8, 1949).

Pitch tuning has several disadvantages. The most notable disadvantages are: (1) the musician is required to manually tighten or loosen the string to be tuned; (2) retuning the instrument back and forth between various notes is inconvenient and time consuming; (3) retuning the instrument is particularly distractive for both the audience and the musician when the continuity of a performance is broken while the musician stops between songs to adjust and fine tune the tension in a string; (4) the success of the retuning is heavily dependent upon the capability of the musician to hear, obtain, and retain the desired tone; and (5) the tone of the string is adversely affected by repetitive adjustments of the string's tension. More importantly, however, the musician must rethink his or her entire fingering scheme, because songs using different bass notes necessarily require use of different chord finger positions. Having to rethink one's fingering scheme each time a different bass note is used is extremely difficult, particularly so, when such fingering varies substantially from a fingering scheme to which the musician is normally accustomed. This latter disadvantage will be discussed further below.

The second method for string tuning is referred to as harmonic or string length tuning. Harmonic tuning is accomplished by altering the distance between the points at which a given string contacts a saddle on a bridge at one end, and a nut or an intermediate fret at the other end. The following disclosures relate to various harmonic tuning methods and devices: Shabram (U.S. Pat. No. 4,183,279; issued Jan. 15, 1980); Lowe (U.S. Pat. No. 3,191,480; issued June 29, 1965); and McBride (U.S. Pat. No. 2,364,861; issued Dec. 12, 1944). Generally, harmonic tuning is accomplished by shortening the effective scale length of a vibrating open string by forcing one or more frets to actually serve as an alternative nut.

The stringed instrument may also be initially constructed, or have its physical structure permanently altered, to provide lengthened strings or additional strings having different scale lengths. For example, a harp, the Asturias 11-string guitar, and the "Multirange Fretted Guitar Type Instrument", described in Penlensky (U.S. Pat. No. 3,392,618; issued July 16, 1968), are instruments specifically designed and constructed to support a variety of strings having different scale lengths. A double headstock design has also been used to support additional, specially chosen, longer strings. Likewise, a fingerboard extension for an upright bass has been used to extend the length of an E string. The fingerboard extension incorporates the use of a stationary pulley, a clamp made of ebony having a leather surface, and a custom-made string to achieve either a deeper or higher bass sound. A string clasp may also be used with a specially designed guitar having an extended string to obtain a deeper or higher bass sound.

The inventor believes the listed patents and known prior art taken alone or in combination neither anticipate nor render obvious the present invention. These citations do not constitute an admission that such disclosures are relevant or material to the present claims. Rather, these citations relate only to the general field of the disclosure and are cited as constituting the closest art of which the inventor is aware.

DISCLOSURE OF INVENTION

It is the general object of the present invention to provide apparatus and methods for selectively extending or shortening the effective scale length of a string on an instrument to obtain a variation of sound, without requiring permanent modification of the instrument's structure, or defacement or mutilation thereof.

A further object of the present invention is to provide apparatus and methods for a chordophone which allows preadjustment of the instrument so that the pitch of a string may be easily changed from one note to another, in rapid fashion, without requiring any careful or critical attention by the musician to manual fine tuning.

An additional object is to provide apparatus and methods for selectively extending or shortening the scale length of a string, wherein such string functions in a manner which avoids interference with the otherwise normal operation of the instrument.

Another object is to provide apparatus and methods for selectively extending or shortening the scale length of a string in such a manner that the musician may quickly and easily move between two different bass notes within a particular chord without having to rethink his or her fingering placement.

Another object is to provide apparatus and methods for selectively generating a deeper or lower sound on a stringed instrument than would otherwise be possible, irrespective of whether the instrument has a standard, electric, or classical design.

Another object is to provide apparatus and methods for preventing the longitudinal displacement of a string with respect to the nut on an electric guitar when a tremolo device is used.

Another object is to provide apparatus and methods for adding weight to the headstock or peghead of a stringed instrument to increase the amplitude and improve the "sustain" of the instrument.

Another object is to provide apparatus and methods which are durable in design, easily constructed, inexpensive and economical to manufacture, and are simple to use.

The present invention achieves these general and specific objects and presents new apparatus and methods for harmonic tuning a stringed instrument, without requiring the defacement or alteration of the instrument's structure. The present invention also overcomes all of the previously mentioned disadvantages by providing a single, simple, compact, rugged, inexpensive, removable attachment for a stringed instrument which is capable of easy attachment and employment.

In a standard tuning, a guitar has an "E" note for its lowest note. When played in the key of E, the E note is the bass note of that key. Much of guitar music, however, is played outside of the key of E and would be better suited with a lower bass note, particularly, with a "D" note. For example, the keys of D, G, C, and A all frequently make use of a D note for a bass note. The lower bass note of D is also the root of the D chord. Therefore, where a song is played in the key of D, the D note is typically the preferred bass note. Additionally, the low-D note is the fifth degree of the G chord, making it an ideal bass note for said chord, especially when alternated between low G and low D, which is impossible without the present invention.

If a guitar was tuned to provide an E note as its lowest bass note, and the musician desired to play a song in the key of D, the E bass note would not harmonize with the other tones in the key of D. The nearest bass note for the D chord that is available on the E string is an F-sharp. Many musicians consider an F-sharp in the key of D to be an undesirable root of the bass note, since it is the third degree of the D chord and as such is harmonically unstable to the ear. The note of D is much more desirable and is much more common.

If a D bass note is desired, then according to the prior art, the tension in the E string must be manually decreased to provide a D note tone. However, since the tension on the E string has been lowered, the finger positioning for chording or noting on that string must be done in an entirely different manner. For example, with the E string artificially loosened, a G chord may be obtained. But to get the G chord one must entirely rethink the chording or fingering pattern. It is very uncomfortable and difficult to rethink one's chording in any key. Consequently, those guitarists who choose to adjust the tension within their E string, must retune their guitar to play other conventional music which use such keys as D, G, and C.

Retuning a guitar is inconvenient. The guitarist usually must stop between songs to complete the retuning, never knowing whether the retuning has been accurate. More importantly, the guitarist must rethink the chording and finger positions because he or she can no longer finger the notes in a manner in which the guitarist is accustomed.

The primary function of the present invention is to permit a musician to shift freely between the E bass note and the D bass note. The present invention permits other shifts between various notes. However, for purposes of illustration and explanation, only a D and E note shift will be discussed.

The present invention includes various embodiments of an apparatus and methods for use thereof which increase the distance beyond the points at which a string normally contacts a bridge and a preexisting nut of an instrument. This is accomplished by providing a removable, secondary or supplemental nut means between the preexisting nut and a receiving tuning peg or peghead of the instrument. In other words, the apparatus of the present invention may be removably secured to the headstock of the instrument so as to position the supplemental nut means between the preexisting nut and the receiving tuning peg. The supplemental nut means lifts the string away from the preexisting nut, thereby extending the effective scale length of the string. When the string is so raised, the preexisting nut may serve as an additional fret.

The tuner apparatus of the present invention may be attached to any standard, electrical, or classical guitar without requiring any structural modification of the instrument whatsoever. Use of the tuner apparatus also does not require any permanent cosmetic alterations of the instrument. A custom built instrument is not required.

The present invention is generally provided with a base portion, a raised portion, and an alternative nut portion. The base portion serves as the foundational support for the raised portion and the alternative nut portion. The base portion may be attached to the headstock of the instrument by various means, such as by clamping. The base portion may itself provide the appropriate elements to clamp itself to the headstock. Such a configuration is discussed below with respect to a design used on classical guitars.

The base portion may alternatively be provided with a bore or slot through which a standard tuning peg may pass. The shaft of the tuning peg may pass through the bore and be affixed to the headstock and tuning machine using any conventional method. Thus, the base portion is clamped to the headstock by utilizing the instrument's existing hardware.

The raised portion supports and elevates the alternative nut portion to a proper elevation. The raised portion may have a tunnel provided therein to allow the lengthened string or other strings of the instrument to pass through without obstructing their function.

The alternative nut portion receives and supports the lengthened string in such a manner as to raise and lift the string away from the preexisting nut of the instrument. The preexisting nut of the guitar is a device which would otherwise stop the vibration length of a string near the headstock of the guitar. Typically, the guitar nut is made from bone, plastic, or brass.

In one embodiment, the height of the alternative nut portion with respect to the headstock and preexisting nut may be adjusted by simply turning the threaded shank of the alternative nut portion within a threaded bore provided within the raised portion.

When properly strung, the string passes over the alternative nut portion and is secured to an appropriate receiving tuning peg. The string is then tuned in a conventional manner. Thus, the alternative nut portion essentially forms and provides an artificial, secondary or alternative nut for the guitar string.

If the spacing between the preexisting nut and the alternative nut means is equivalent to the distance between two frets, then use of the tuner apparatus would cause the string to sound a low D note rather than a low E note. Musically speaking, such spacing or distance encompasses one whole step, or in other words, the difference between the vibration length of the D note and the E note.

With the device in place, a low D note may be sounded. If a G chord is desired to be played, which is the next logical chord in the key of D, the G chord may be played normally without any rethinking of how the chord should be played or altering of the finger positions of the left hand. The musician may also alternate between the bass notes of G and D within the G chord without any significant modification of the left hand fingering.

All the chords, whatever the chord would be, are played the same as they would otherwise be on the guitar, provided, the index finger must stop the string behind the nut if one wishes to play an E bass note or an E chord. This is done by employing a common fingering pattern known by guitarists as an "F-barre" position. In other words, play an "F-barre" chord and slide the fingering position downward, putting the index finger behind the preexisting guitar nut, just as an F chord were being played. With a finger located behind the preexisting nut, one can play the normal E chord.

If a guitarist wishes to play with a bass E note on a constant basis, without having to press the string behind the preexisting nut, there are several different methods by which this may be achieved. For example, a locking means, such as a latch or a cantilevered string clasp, may be used.

The latch may be pivotally attached near or to the preexisting nut or to the instrument itself. When appropriately rotated, the latch either becomes inoperative and unobtrusive or serves to urge the lengthened string against the preexisting nut. For example, the latch may be moved to simply slide over the string, locking it in place against the preexisting nut. This method allows the guitarist to easily, quickly, and simply lock the string with a bass E note at any time while playing a song. The latch acts as an artificial finger, locking the string down at the preexisting nut. The guitarist simply presses the string downward behind the preexisting nut. The clasping device then slides over the string giving the guitarist a bass E note on a continual basis. This device may be engaged and disengaged quickly with one hand, in the middle of a song if need be.

An alternate method of securing the string at a bass E note uses a cantilevered string clasp. The cantilevered string clasp extends from the side of the tuner apparatus. By merely moving the string downward and carefully sliding it under the arm of the cantilevered string clasp, the string is held down against the preexisting guitar nut. The cantilevered string clasp then holds the string in this position. Again, the device simply acts as an artificial finger to force the string against the preexisting guitar nut.

An additional utilization of such a cantilevered string clasp is that the vibration distance between the preexisting nut and the artificial nut is carefully positioned to lie exactly where an additional fret would be located between the notes of D and E. Thus, the cantilevered string clasp may be used as another fret to provide an additional D-sharp note or an E-flat note which are playable on a standard guitar. It is not contemplated that such notes will be played very frequently. However, these notes may be achieved by use of the device having the cantilevered string clasp extending therefrom.

In another embodiment of the present invention, the secondary or supplemental nut means is provided with means of lateral adjustment. Such lateral adjustment means may comprise the use of a separable base portion and raised portion. The separable base portion and raised portion are attached to each other in such a manner that the distance between the alternative nut portion, which is secured to the raised portion, and the bore or slot, which is located in the base portion through which the tuning peg is passed, is adjustable. This may be accomplished by providing the base portion with a channel on each side thereof and providing the raised portion with opposing flanges that are juxtaposed near the channel. Each flange has a threaded bore through which a set screw is placed. The set screw may be rotated to enter the channel and engage the base portion. Thus configured, the lateral distance between the bore of the base portion and the alternative nut portion may be adjusted by: loosening the set screw; moving the raised portion with respect to the base portion; and retightening the set screw.

These and other objects and advantages of the present invention will become more readily apparent upon reading the following disclosure and referring to the attached drawings.

BRIEF DESCRIPTION OF DRAWINGS

FIG. 9 is an isometric view of another embodiment of the tuner apparatus as applied to an electrical guitar.

FIG. 13 is a fragmentary, isometric view of another embodiment of the apparatus which is especially designed for use with classical guitars.

FIG. 14 is an isometric view of the apparatus of FIG. 13 shown attached to a classical guitar shown in phantom lines.

One should understand the drawings are not necessarily to scale and the elements are sometimes illustrated by graphic symbols, phantom lines, diagrammatic representations, and fragmentary views. In certain instances, the inventor may have omitted details which are not necessary for an understanding of the present invention or which render other details difficult to perceive.

BEST MODE FOR CARRYING OUT THE INVENTION

Figure 1:
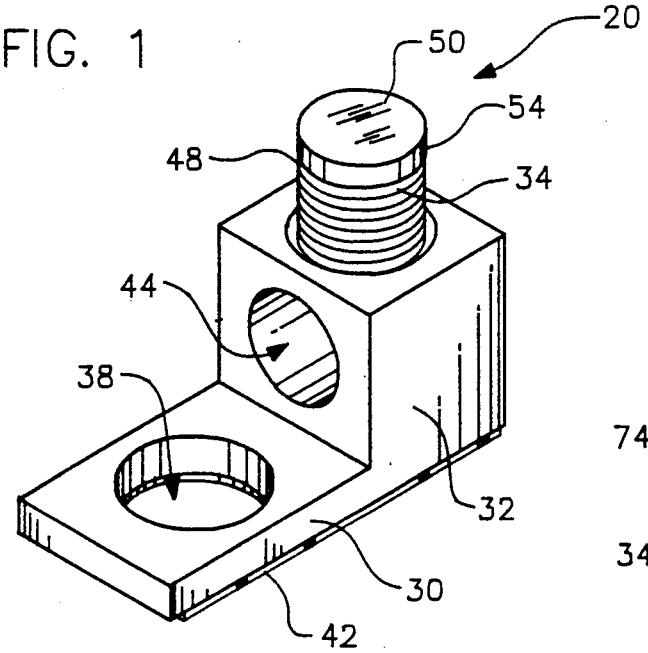
FIG. 1 is an isometric view of the tuner apparatus.
Figure 10:
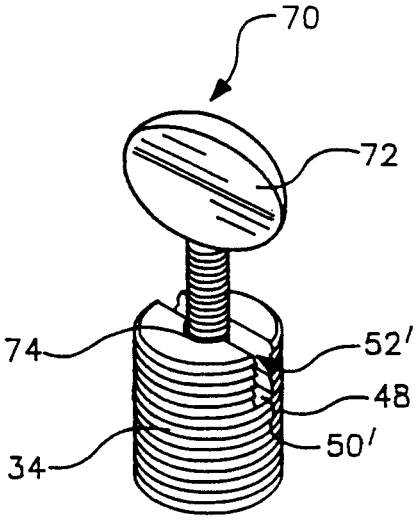
FIG. 10 is an isometric view of the alternative nut portion and clamping mean shown in FIG. 9 which is especially designed for use with the strings of an electrical guitar.
Figure 2:
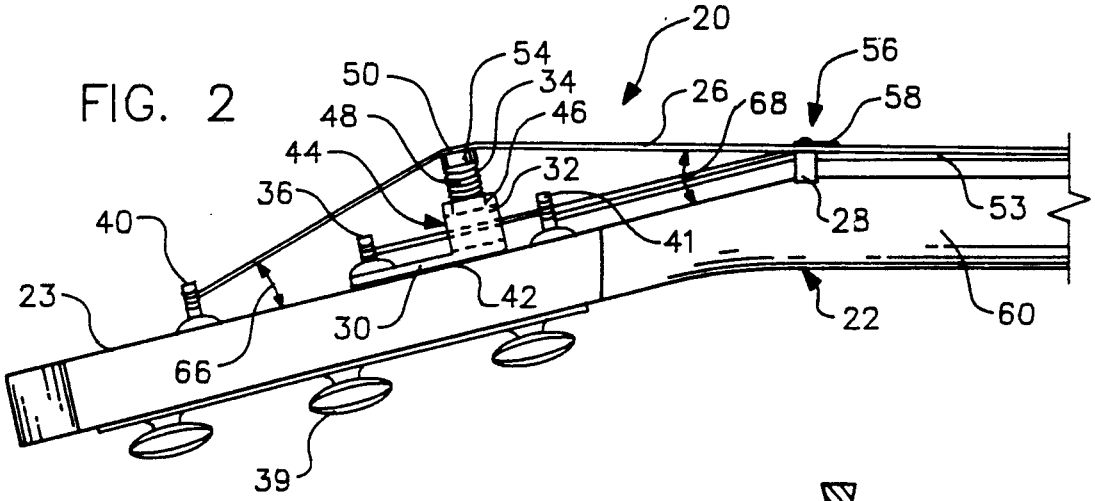
FIG. 2 is an elevational view of the tuner apparatus of FIG. 1 shown attached to a headstock of a guitar.
Figure 11:
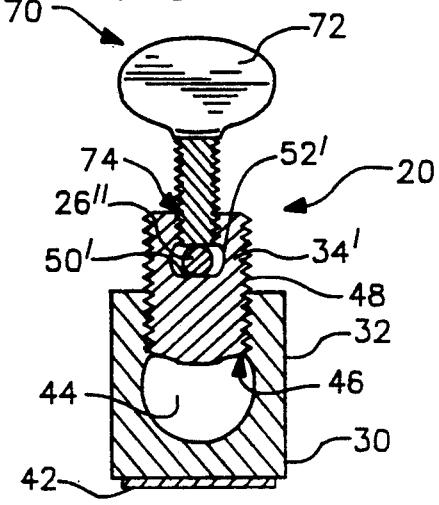
FIG. 11 is a sectional view taken along line XI—XI of FIG. 9 illustrating a cross-sectional view of the supplemental nut means and clamping means shown in FIGS. 9 and 10.
Figure 12:
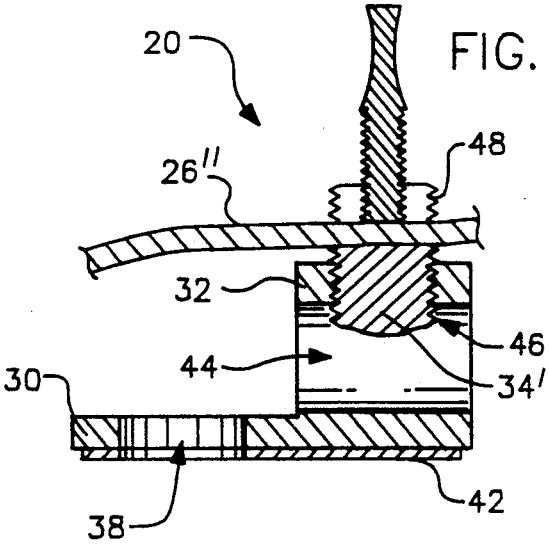
FIG. 12 is a sectional view taken along line XII—XII of FIG. 9 further illustrating the function of the clamping means shown in FIGS. 9 through 11.

Referring to the drawings and particularly to FIGS. 1 and 2, wherein like numerals indicate like parts, a tuner apparatus 20 as taught herein is generally a simple, durable, easily constructed, and inexpensive attachment for a stringed instrument 22, such as a guitar or other chordophone. As shown in FIG. 2, tuner apparatus 20 may be removably attached to a headstock 23 of instrument 22 without requiring permanent modification or defacement of instrument 22. The function of tuner apparatus 20 is to serve as an alternative, secondary, or supplemental nut means capable of urging a particular string 26 away from a preexisting nut 28, thereby increasing the effective scale length of string 26. For purposes of illustration, numeral 20 refers to tuner apparatus 20, which defines the supplemental nut means. Since the supplemental nut means is located further up on headstock 23, as compared to the position of preexisting nut 28, and since string 26 is raised from contacting preexisting nut 28, the supplemental nut means significantly extends the effective scale length of string 26.

Figure 4:
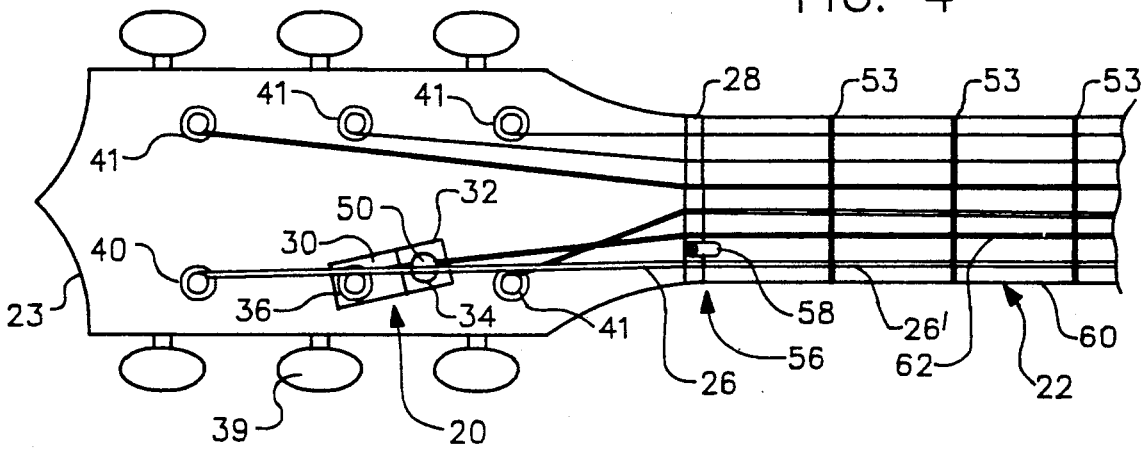
FIG. 4 is a schematic plan view of the tuner apparatus shown in FIGS. 1 through 3, wherein the locking means is located in a disengaged or inoperative position.
Figure 5:
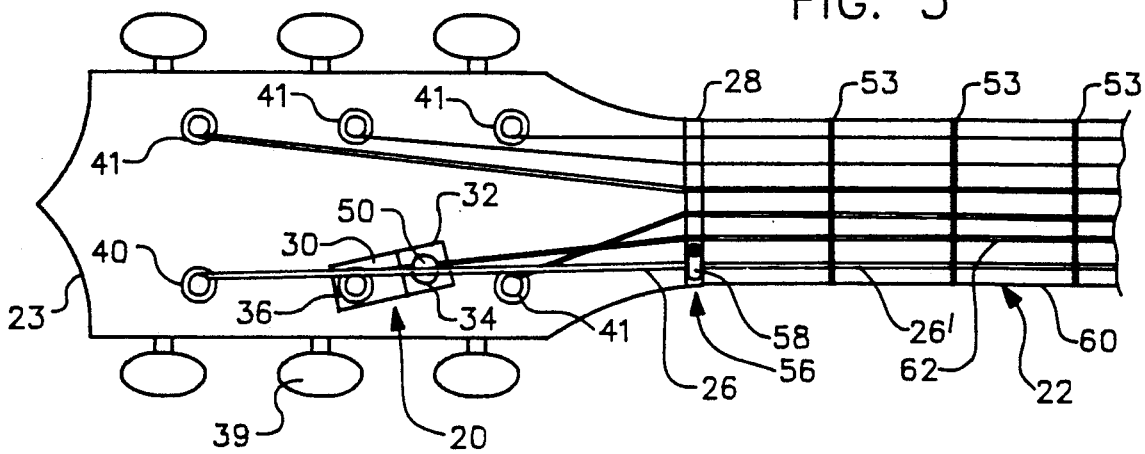
FIG. 5 is a schematic plan view of the tuner apparatus shown in FIGS. 1 through 4, wherein the locking means is located in an engaged or operative position.

The added scale length is determined by measuring the distance between where string 26 would otherwise have contacted preexisting nut 28 and where string 26 first contacts the supplemental nut means. If this distance is equivalent to the distance between two frets, then a half-step lower in note pitch is achieved. If such distance is calculated to be the proper distance between three frets, as can be seen in FIGS. 4 and 5, then two half-steps or one whole-step lower in note pitch is achieved.

Use of preexisting nut 28 ma be resumed by urging string 26 against preexisting nut 28.

By alternating the use of the supplemental nut means and preexisting nut 28 as the effective nut during play, a musician may selectively increase and decrease the effective scale length of string 26 to obtain a significant variation of sound.

Since the locations of where string 26 contacts the supplemental nut means and preexisting nut 28 are fixed, the effective scale length of string 26 may be predetermined and finely adjusted. Further adjustment is generally unnecessary. The musician may then freely use either the supplemental nut means or preexisting nut 28 without having to readjust the tension in string 26 after each selection.

As shown in FIGS. 1 and 2, which illustrate the preferred embodiment, the supplemental nut means, which defines tuner apparatus 20, generally comprises: a base portion 30; a raised portion 32; and an adjustable, secondary or alternative nut portion 34.

As shown in FIGS. 2, 4–5, and 7–9, base portion 30 is designed to rest against headstock 23 of instrument 22 and serve as a foundational support against which raised portion 32 and alternative nut portion 34 may be urged without causing damage to instrument 22. This may be done by juxtaposing and securing the lower surface of base portion 30 against the upper surface of headstock 23. Base portion 30 also enables attachment of tuner 20 to instrument 22.

To maintain consistency in tone and pitch, base portion 30 should be restrained from lateral movement with respect to headstock 23. This may be accomplished by affixing base portion 30 to headstock 23 by any adequate means, such as with an epoxy, a screw, a nut, or the like. Several of such attachment means, however, may cause damage to the surface or structure of instrument 22.

In the preferred embodiment, base portion 30 is restricted from movement by removably securing base portion 30 to a desired tuning peg 36. In particular, base portion 30 is provided with a generally vertical bore 38 through which a preselected tuning peg 36 may pass. Bore 38 is located in a generally perpendicular fashion to the lower surface of base portion 30, and is large enough to allow for the passage of tuning peg 36. Once tuning peg 36 has been inserted into bore 38, base portion 30 is juxtaposed against headstock 23 so that tuning peg 36 extends downwardly and outwardly through headstock 23 in a normal fashion. Tuning peg 36 is then secured to a tuning machine 39 in any conventional manner, thereby securing base portion 30 in a secured, removable, and adjustable position against headstock 23.

String 26 or an alternative string may be attached to tuning peg 36 using conventional methods which are well known in the industry. In the embodiments illustrated in the attached drawings, the inventor prefers to secure the terminal end of string 26 to receiving tuning peg 40. The attachment of base portion 30 to tuning peg 36 does not adversely affect the function of tuning pegs 36 or 40, nor does it adversely affect the other tuning pegs 41 on headstock 23.

To protect and prevent damage to headstock 23 from abrasion or defacement, and particularly to the upper surface thereof, padding means 42 may be juxtaposed between the lower surface of base portion 30 and the upper surface of headstock 23. Padding means 42 is shown in FIGS. 1–2, 6, 11–12, and 13–14. Padding means 42 may be made of a relatively thin layer of cork, felt, cloth, rubber, leather, foam material, plastic, or the like.

In the preferred embodiment, padding means 42 is attached to the lower surface of base portion 30 by any appropriate means, such as with an adhesive. By adhering the optional padding means 42 to the lower surface of base portion 30, tuner apparatus 20 remains a single unit for easy attachment to instrument 22.

Raised portion 32 extends in a generally upwardly fashion from base portion 30. As found in the preferred embodiment, raised portion 32 may be integrally formed with base portion 30. Alternatively, raised portion 32 may be secured to the upper surface of base portion 30. The purpose of raised portion 32 is to support and adjustably lift alternative nut portion 34 to a desired position.

The inventor has discovered that many tuning machines 39 of various headstocks 23 require close proximity of each tuning peg 36, 40 and 41. Consequently, the various strings for each tuning peg 36, 40 and 41 are also in close proximity to one another. To facilitate direct and unobstructed connection of the strings of instrument 22 to tuning pegs 36, 40, and 41 of tuning machine 39, a generally longitudinal tunnel 44 is provided within raised portion 32 of the preferred embodiment. Tunnel 44 in raised portion 32 is generally perpendicular to bore 38 of base portion 30. If necessary, string 26 or another string may pass through tunnel 44 without being adversely affected. This principle is shown in FIGS. 2, 7-9, and 11-12.

Alternative nut portion 34 urges string 26 away from preexisting nut 28 and supports string 26 at an increased effective scale length. Toward this end, alternative nut portion 34 is adjustably secured to raised portion 32. Raised portion 32 supports and adjustably raises alternative nut portion 34 to a desired position. This may be accomplished by providing raised portion 32 with a tapped bore 46 therein. See FIGS. 11 and 12. Alternative nut portion 34 partially penetrates tapped bore 46 and adjustably engages raised portion 32 within tapped bore 46. Alternative nut portion 34 may be provided with a threaded shank 48 to engage raised portion 32 within tapped bore 46. For example, in the preferred embodiment, the inventor simply uses a threaded shank 48 for alternative nut portion 34. Threaded shank 48 is simply inserted into and engages tapped bore 46 in raised portion 32. By rotating threaded shank 48, alternative nut portion 34 may be easily raised or lowered to a correct position.

Alternative nut portion 34 has an upper receiving surface 50 upon which string 26 is urged. Upper receiving surface 50 acts as a secondary or alternative nut for string 26. The height of upper receiving surface 50, with respect to base portion 30, raised portion 32, and headstock 23, may be adjustably raised or lowered as described in the preceding paragraph, or may be adjusted by any other like manner.

Upper receiving surface 50 receives and supports the placement of string 26. Upper receiving surface 50 may be provided with a grooved indentation, slot, or channel 52, shown in FIG. 6, within which string 26 is supported. String 26 rests within the indentation, slot, or channel 52 during use. The height of receiving surface 50 should be adjusted to support and lift string 26 away from preexisting nut 28. This extends the effective length or scale length of string 26. When string 26 is so raised, preexisting nut 28 may serve as an additional fret 53.

Figure 6:
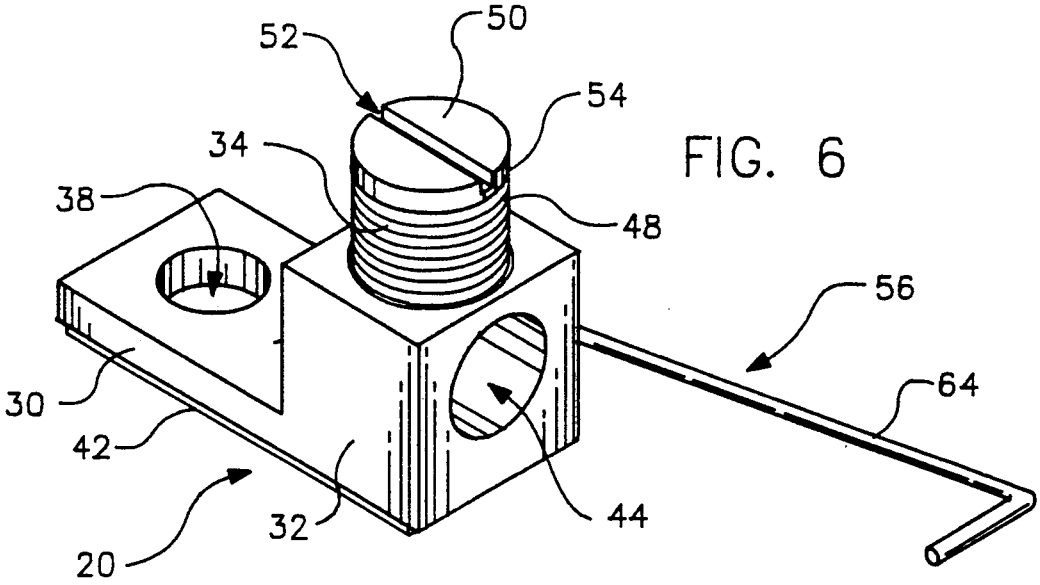
FIG. 6 is an isometric view of a second embodiment of the tuner apparatus, wherein the apparatus has a cantilevered string clasp extending therefrom.

As shown in FIGS. 1-2, and 6, alternative nut portion 34 may also be provided with a cap 54 to serve as upper receiving surface 50. Cap 54 may be made of any appropriate material such as bone, plastic, leather, metal, or the like. Cap 54 may be replaceable and serve to protect string 26 from excessive wear against tuner apparatus 20. Cap 54 may also be provided with a grooved indentation, slot or channel 52, as set forth above.

Although not required to practice the invention, a holding or locking means 56, having an operative position and an inoperative position, may also be provided. When it is desired to use string 26 with an increased effective scale length, locking means 56 may be released or repositioned to its inoperative position so as to not obstruct the use or vibration of lengthened string 26 or that of the other strings. Locking means 56, therefore, allows the supplemental nut means to lift string 26 away from preexisting nut 28 when locking means 56 is located in its inoperative position.

Figure 3:
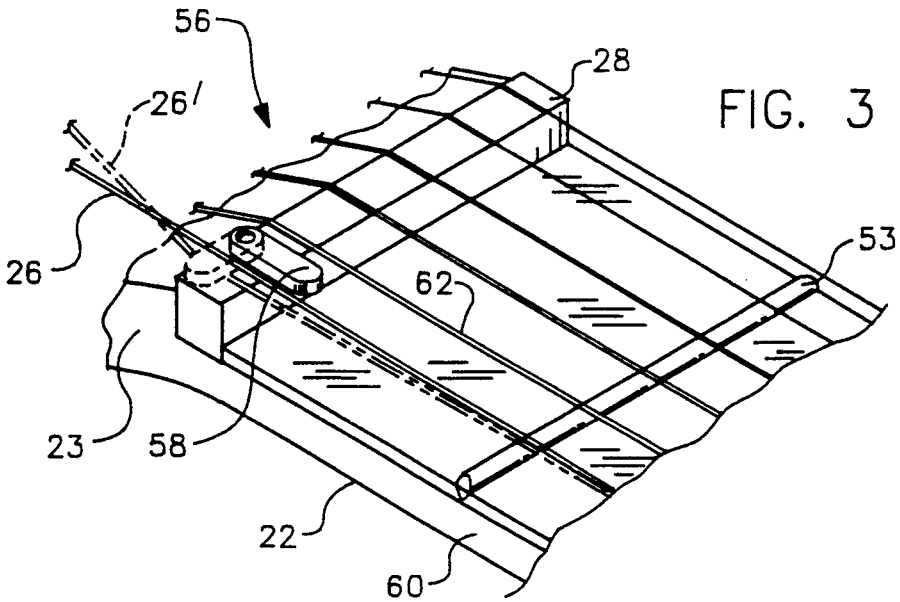
FIG. 3 is a schematic, fragmentary, isometric view of locking means as applied to a preexisting nut of a guitar.

When it is desired to use string 26 in a traditional manner, with a standard effective scale length which is not lengthened, then locking means 56 is engaged in its operative position. When located in its operative position, locking means 56 urges string 26 against preexisting nut 28, thereby, negating the effect of the supplemental nut means. This feature is particularly shown in FIGS. 3-5, wherein string 26 has an increased effective length, and string 26' (shown in FIG. 3 with phantom lines) operates in a traditional manner without an increased effective length.

Locking means 56 may comprise various embodiments. In the preferred embodiment, as shown in FIGS. 2-5, locking means 56 comprises a catch or a latch 58 which is secured to neck 60 or to preexisting nut 28 of instrument 22. Latch 58 may, for example, comprise an eye screw or other locking or holding means which is attached to preexisting nut 28 adjacent to string 26, with latch 58 being capable of pivotal movement between an inoperative position best shown in FIG. 4, and an operative position best shown in FIG. 5. In its inoperative position, latch 58 is positioned between strings 26 and its adjacent string 62. In its operative position, latch 58 is pivoted to hold string 26 against preexisting nut 28.

Figure 7:
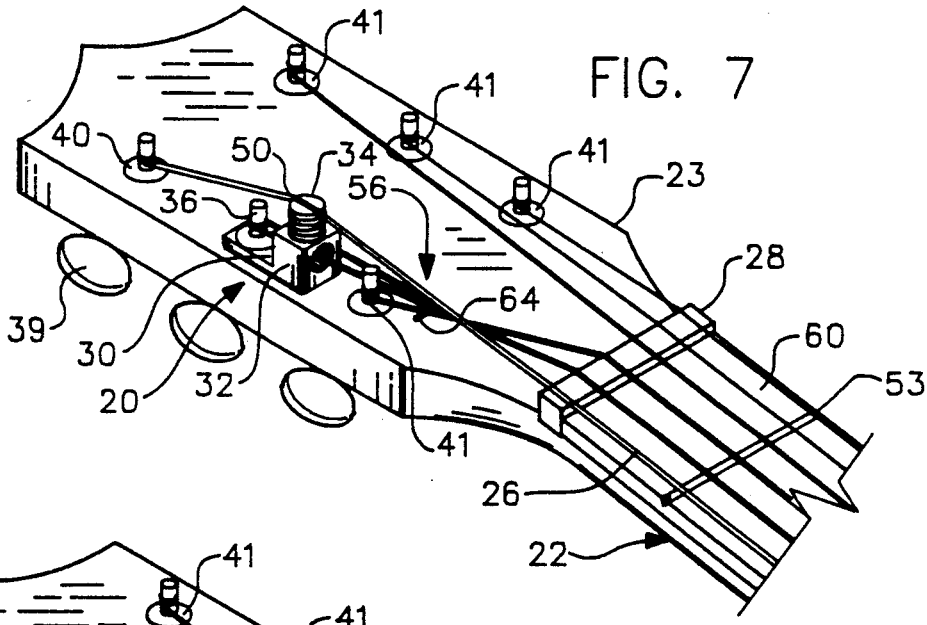
FIG. 7 is an isometric view of the embodiment shown in FIG. 6 as attached to a headstock of a guitar, the cantilevered string clasp being located in an inoperative position.
Figure 8:
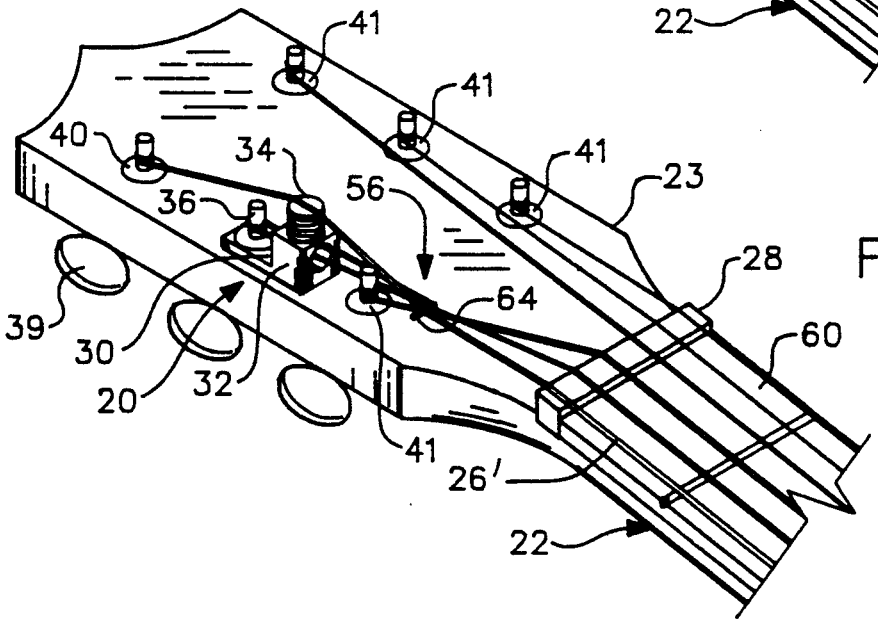
FIG. 8 is an isometric view of the embodiment shown in FIGS. 6 and 7, wherein the cantilevered string clasp is located in an operative position.

In another embodiment, as shown in FIGS. 6-8, locking means 56 comprises a cantilevered arm or string clasp 64 which is attached to and extends from either base portion 30 or raised portion 32 of the supplemental nut means. When it is desired to use string 26 with an increased effective scale length, string 26 is moved above string clasp 64 so that string 26 is not contacted or its operation affected. This is the inoperative position for string clasp 64. This position enables the supplemental nut means to lift string 26 away from preexisting nut 28.

String clasp 64 may be located so that when string 26 is contacted, the distance between string clasp 64 and preexisting nut 28 is the same distance as between two adjacent frets. Then when string clasp 64 is retained in an inoperative position, string clasp 64 may serve as an additional fret 53 between alternative nut portion 34 and preexisting nut 28, thereby, giving instrument 22 yet another note which would be otherwise unavailable.

When it is desired to use string 26' with a standard effective scale length, which is not lengthened, string 26' is moved below string clasp 64. This is the operative position for string clasp 64. Thus, string clasp 64 forces string 26'' downward until string 26' is urged against preexisting nut 28, negating the effect of the supplemental nut means. Cantilevered string clasp 64 may be constructed of spring steel or material having a similar resilient characteristic to enable easy operation.

FIG. 9 illustrates tuner apparatus 20 attached to an electrical guitar 22', having a "six on a row" tuning machine 39' on headstock 23'. On such a guitar 22', string 26'' is preferably passed over preexisting nut 28 and then urged against upper receiving surface 50 of alternative nut portion 34'. String 26' continues from alternative nut portion 34' and is passed around tuning peg 40'. In effect, tuning peg 40' serves as a pulley mechanism to reduce string friction and allow an adequately reasonable string break angle 66 (shown in FIG. 2). If string break angle 66 is too sharp, string 26'' may break during use. It is preferred that string break angle 66 be as close as possible in angle of inclination as angle 68 (shown in FIG. 2). Once leaving tuning peg 40', string 26'' passes through tunnel 44 and is secured to the sixth peg, which is receiving tuning peg 40.

If the musician is not concerned about the angle of inclination for break angle 66, then after string 26'' passes over alternative nut portion 34, string 26'' may be passed directly through tunnel 44 and be secured to tuning peg 36, or to any other appropriate tuning peg.

When electric guitar 22' is used with a tremolo arm (not shown), the tension of string 26'' at headstock 23 is repetitively altered. For example, when the tension is increased, string 26'' moves slightly forward toward the bridge (not shown). When tension is released, it is difficult for string 26'' to resume its earlier tension and location. To prevent the longitudinal movement of string 26'' within channel 52', alternative nut portion 34 is provided with clamping means 70. Clamping means 70 secures string 26'' to supplemental nut portion 34. Use of clamping means 70 is not required to practice the present invention. However, its use is suggested when a tremolo device is used.

In the preferred embodiment, clamping means 70 comprises a bolt or threaded wing-nut 72 which engages another tapped bore 74 formed within alternative nut portion 34. Threaded wing-nut 72 presses downward upon string 26'' forcing string 26'' against a bottom surface of channel 52', which in turn, serves as upper receiving surface 50'. This prevents longitudinal movement of string 26'' within channel 52'.

The present invention takes on a different configuration when used with a classical guitar 22''. Referring to FIGS. 13 and 14, a classical guitar typically has a slotted headstock 23' with horizontally placed tuning pegs 40'' and 41' located therein. Consequently, it is difficult to attach base portion 30' of tuner apparatus 20' to a tuning peg 36. Instead, the inventor prefers to use an independent, freestanding tuner apparatus 20', wherein base portion 30' comprises a means for passing through the slots of headstock 23' and clamping securely to both the upper and lower surfaces of headstock 23'. This may be accomplished by using a bolt 75 or similar device having removable washers 76, or the like, attached thereto. One of the washers 76 may be removed, and bolt 75 passed through an appropriate slot in guitar 22''. The removed washer 76 is reattached, clamping tuner apparatus 20' to headstock 23'.

Raised portion 32' may comprise an extension of bolt 75 which serves to raise string 26 away from preexisting nut 28.

Alternative nut portion 34' may comprise a nut or other supporting surface attached to the upper end of raised portion 32'. Slots or a channel 52' may be provided within alternative nut portion 34' to receive and support string 26. String 26 is then passed toward and secured to receiving tuning peg 40''.

Figure 15:
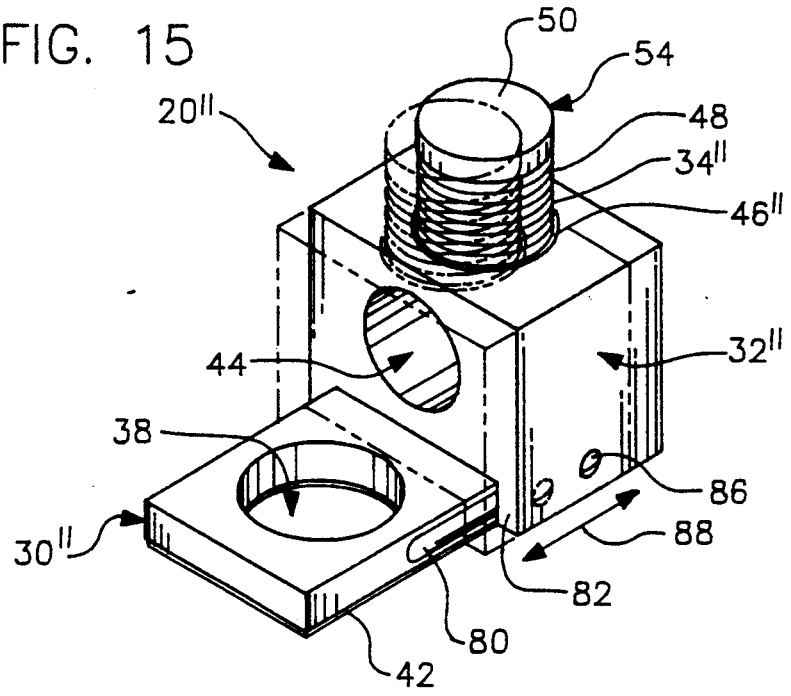
FIG. 15 is an isometric view of an alternative embodiment of the tuner apparatus, wherein a raised portion is selectively movable with respect to a base portion.
Figure 16:
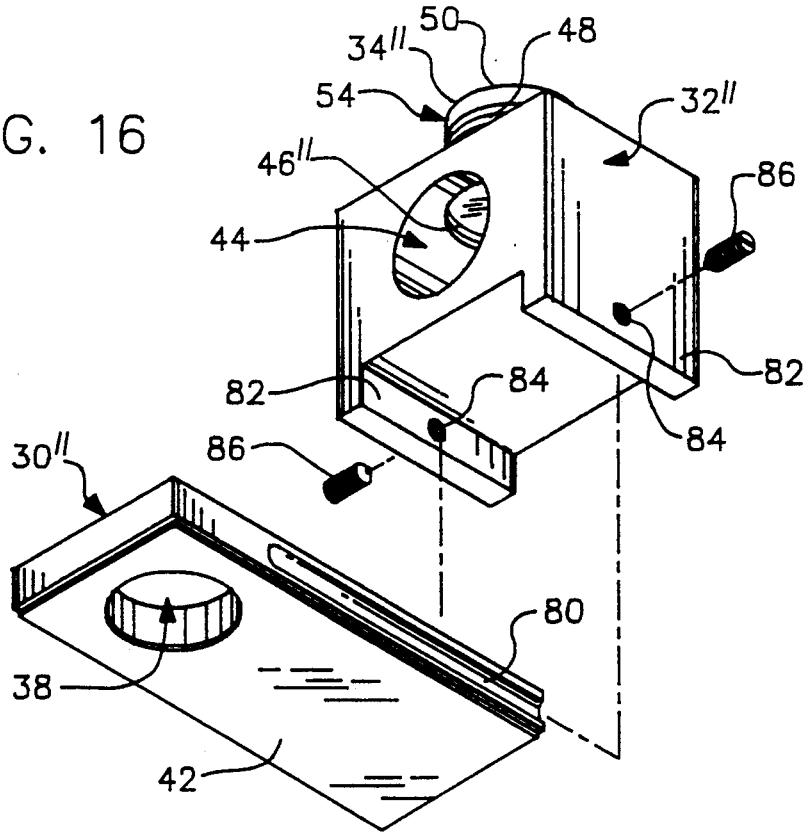
FIG. 16 is an exploded isometric view of the apparatus shown in FIG. 15.

Referring now to FIGS. 15 and 16, which disclose an even further embodiment of the present invention, the secondary or supplemental nut means, which is defined by tuner apparatus 20'', is provided with means of lateral adjustment so that the altered effective scale length of string 26 may be precisely adjusted. Such lateral adjustment means may comprise the use of an extendable, retractable and/or separable base portion 30'' and raised portion 32''.

For example, separable base portion 30'' and raised portion 32'' are preferably attached to each other in such a manner that the distance between alternative nut portion 34'' and slot or bore 38, which is located in separable base portion 30'' through which tuning peg 36 is passed, is adjustable. This may be accomplished by providing separable base portion 30'' with a channel 80 on each side thereof and by providing raised portion 32'' with opposing flanges 82 that are juxtaposed near channels 80. Each flange 82 has a threaded bore 84 through which a set screw 86 is placed. Set screw 86 may be rotated to pass into bore 84 and channel 80 and engage separable base portion 30''. Thus configured, the lateral distance between bore 38 of base portion 30'' and alternative nut portion 34'', which is secured to raised portion 32'' within tapped bore 46'', may be adjusted by: loosening set screw 86; moving raised portion 32'' with respect to separable base portion 30'' in a direction generally indicated by arrow 88; and retightening set screw 86. FIG. 15 illustrates in phantom lines the lateral adjustment or relocation of raised portion 32'' closer to bore 38.

An added benefit of using the present invention is that it increases the "sustain" of the instrument 22. "Sustain" is generally defined as the ability of the tone generated by an acoustical instrument 22 to continue without dissipating into the wood or other materials of instrument 22. Basically, the more dense the materials, the longer the tone will ring out without dissipation. The addition of weight to headstock 23 operates to minimize the vibrations of headstock 23, thereby reducing the amount of string energy which is dissipated into instrument 22 through vibrating headstock 23. Because tuner apparatus 20 is attached to headstock 23 of instrument 22, it adds mass at that point. In addition, tuner apparatus 20 acts to transfer string tension to a known weaker portion of headstock 23. Consequently, tuner apparatus 20 operates to increase the sustain characteristics of instrument 22, allowing instrument 2 to ring slightly longer in time without diminishing, particularly on lower notes, than would otherwise be available. This is another benefit of using tuner apparatus 20.

Tuner apparatus 20 may be made of any material having the necessary characteristics as described herein.

In addition to the apparatus disclosed above, the present invention includes various methods of selectively increasing and decreasing an effective length of string 26 on stringed instrument 22. For example, in its broadest sense, the present invention teaches the steps of: (a) removably securing the supplemental nut means to a headstock of an instrument in such a manner as to avoid permanent modification and defacement of such instrument; and (b) urging a string of the instrument against the supplemental nut means so that the string is lifted away from contacting a preexisting nut of the instrument, thereby increasing the effective scale length of the string.

Where the supplemental nut means as described above is used, the step of removably securing the supplemental nut means to headstock 23 may be accomplished by: (a) passing tuning peg 36 through bore 38 in base portion 30; (b) juxtaposing base portion 30 against the upper surface of headstock 23; and (c) securing tuning peg 36 to tuning machine 39. Likewise, the step of urging string 26 against the supplemental nut means may be accomplished by: (a) adjusting the lateral position of the supplemental nut means to proper alignment with the longitudinal direction of string 26; (b) adjusting the vertical position of alternative nut portion 34, with respect to the position of headstock 23 and preexisting nut 28, to urge and support string 26 away from preexisting nut 28, and to support string 26 at an increased effective scale length than would otherwise be available if string 26 were to contact preexisting nut 28; (c) urging string 26 against alternative nut portion 34; (d) securing string 26 to an appropriate receiving tuning peg 40 on tuning machine 39; and (e) adjusting tuning machine 39 to increase the tension within string 26 to obtain a desired pitch.

An additional step may include selectively determining whether or not string 26 contacts preexisting nut 28. This may be done by selectively causing string 26 to either contact or to not contact preexisting nut 28. Contact may be caused by forcing string 26 against preexisting nut 28. This negates the increased effective scale length of string 26 which would otherwise occur when tuner apparatus 20 is used. If string 26 is allowed to assume an elevated position above preexisting nut 28, the increased effective scale length of string 26 may be utilized.

For example, if string 26 is used with tuner apparatus 20 and is tuned to produce a "D" note, and the distance between alternative nut portion 34 and preexisting nut 28 is equivalent to the distance between two frets 53, then a "D" note will sound if preexisting nut 28 is not contacted. If string 26 is urged against preexisting nut 28, then an "E" note will sound.

Figure 17:
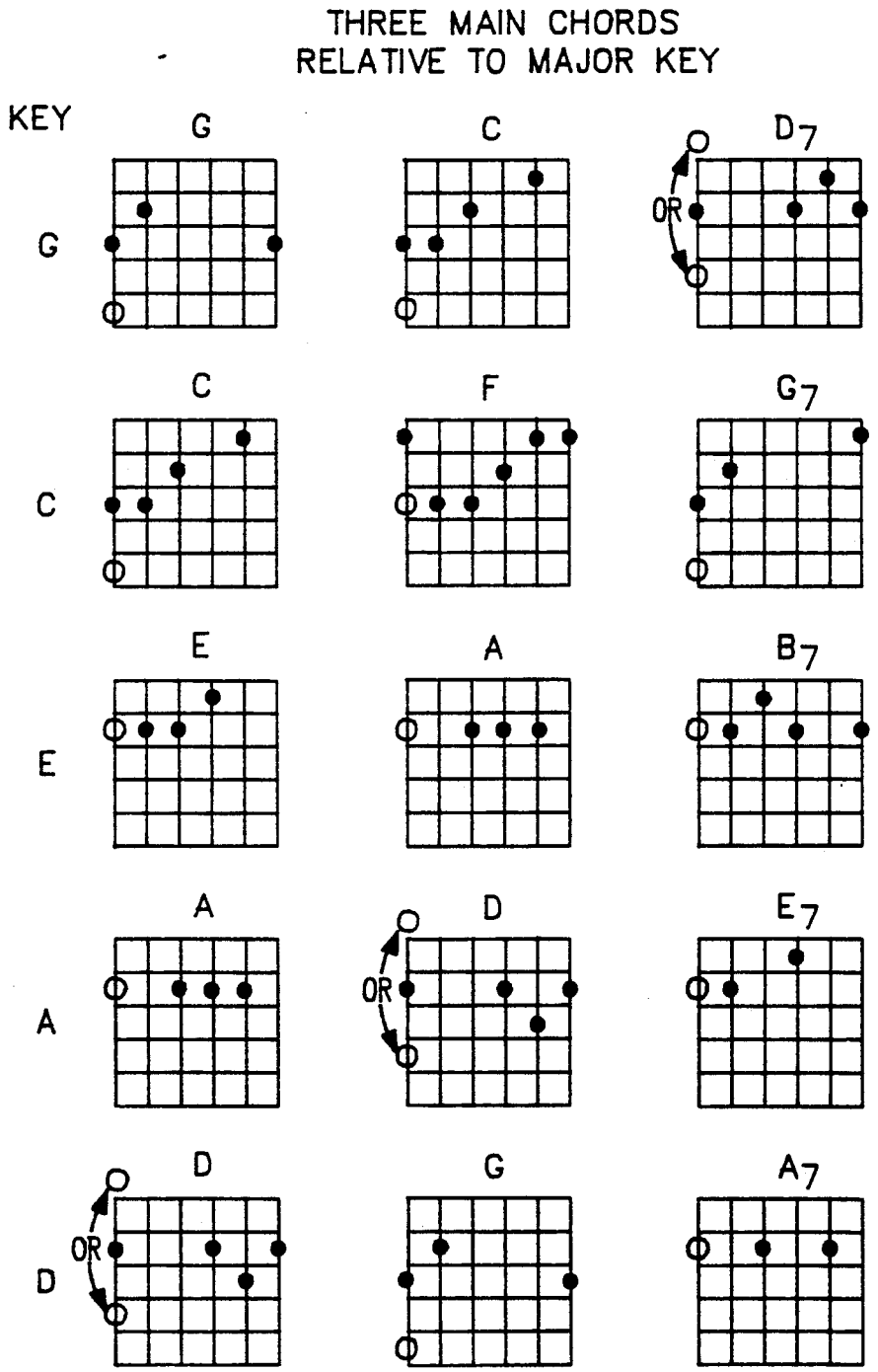
FIG. 17 illustrates schematically the finger positioning for various chords played with the present invention as compared to comparable finger positions if the present invention was not used and, instead, the tension in the string was altered.

By way of further example, FIG. 17 illustrates the finger positioning for various chords played with a string 26 having an increased effective scale length as compared to comparable finger positions if tuner apparatus 20 were not used and instead the tension in string 26 were altered. Referring to the charts of FIG. 17, the line located to the furthermost left of each chart represents the 6th string o bottom E string of the instrument. The line located to the furthermost right of each chart represents the 1st string or top E string of the instrument. The uppermost horizontal line of each chart represents preexisting nut 28. The remaining horizontal lines represent frets. The filled dots indicate standard finger placement which are usually played for a given chord, indicated by a letter above each chart, that is within a given key, indicated by a letter in a left-most column. The open circles indicate alternative finger placement on the 6th string or bottom E string when the present invention is used to lengthen the effective length of string 26.

The means and construction disclosed herein are by way of example and comprise primarily the preferred form of putting the invention into effect. Although the drawings depict a preferred and alternative embodiments of the invention, other embodiments have been described within the preceding text. One skilled in the art may appreciate that the disclosed device may have a wide variety of shapes and configurations. Additionally, persons skilled in the art to which the invention pertains might consider the foregoing teachings in making various modifications, other embodiments, and alternative forms of the invention.

It is, therefore, to be understood that the invention is not limited to the particular embodiments or specific features shown herein. To the contrary, the inventor claims the invention in all of its forms, including all alternatives, modifications, equivalents, and alternative embodiments which fall within the legitimate and valid scope of the appended claims, appropriately interpreted under the Doctrine of Equivalents.

INDUSTRIAL APPLICABILITY

The tuner apparatus and methods for use thereof as described herein may be used to harmonically tune a variety of stringed instruments, including a standard, electric, and classical guitar. The tuner apparatus enables a musician to quickly, easily, and selectively extend and shorten the effective scale length of a string on a guitar or other chordophone, without requiring permanent modification or defacement of the instrument's structure. Of particular importance, is that the present apparatus and methods allow the musician to play a variation of chords having bass notes which are deeper or lower in tone than would otherwise be available on such an instrument, and to do so without having to significantly rethink fingering placement. The various scale lengths of the string may also be preadjusted to alleviate the need for the musician to manually fine tune the note after each selection. In addition, the apparatus improves the amplitude and sustain of the instrument, and may be used to prevent the longitudinal displacement of the string with respect to the nut on an electric guitar when a tremolo device is used. The apparatus is very durable in design, easily constructed, inexpensive and economical to manufacture, and is extremely simple to use.

I claim:

1. An apparatus for attachment to a stringed instrument, the instrument having a preexisting nut, a string whose pitch is controlled by an effective scale length of the string, a headstock, and a tuning peg, the apparatus comprising:

(a) supplemental nut means capable of being removably secured to the instrument, said supplemental nut means being capable of urging the string away from the preexisting nut, thereby increasing the effective scale length of the string;

(b) wherein said supplemental nut means includes (i) a base portion defining a foundational support of said supplemental nut means, said base portion being juxtaposed against the headstock of the instrument, (ii) a raised portion extending from said base portion, (iii) an alternative nut portion adjustably secured to said raised portion, said raised portion supporting and adjustably raising said alternative nut portion to a desired position, said alternative nut portion urging the string away from the preexisting nut and supporting the string at an increased effective scale length, and (c) wherein said supplemental nut means is removably secured to the tuning peg of the instrument without requiring modification or defacement of the headstock.

2. The apparatus of claim 1, further comprising padding means juxtaposed between said base portion and the headstock to protect the headstock from abrasion or defacement.

3. The apparatus of claim 2, wherein said padding means is made from a relatively thin layer of cork, felt, cloth, rubber, leather, or plastic.

4. The apparatus of claim 1, wherein said raised portion is provided with a tapped bore, said alternative nut portion adjustably engaging said raised portion within said tapped bore.

5. The apparatus of claim 4, wherein said alternative nut portion comprises a threaded shank which engages said raised portion within said tapped bore.

6. The apparatus of claim 1, wherein said alternative nut portion is provided with a channel within which the string is supported.

7. The apparatus of claim 1, wherein said alternative nut portion further comprises a cap, said cap receiving and supporting the string.

8. The apparatus of claim 7, wherein said cap is provided with a channel within which the string is supported.

9. The apparatus of claim 1, further comprising locking means, said locking means having an operative position and an inoperative position, said locking means urging the string against the preexisting nut when located in said operative position, and said locking means allowing said supplemental nut means to lift the string away from the preexisting nut when located in said inoperative position, said locking means having a latch or a catch secured to the instrument, said latch or said catch being capable of pivotal movement between said operative position and said inoperative position.

10. The apparatus of claim 1, further comprising locking means, said locking means having an operative position and an inoperative position, said locking means urging the string against the preexisting nut when located in said operative position, and said locking means allowing said supplemental nut means to lift the string away from the preexisting nut when located in said inoperative position, said locking means comprising a cantilevered string clasp extending from said supplemental nut means, said string clasp holding the string against the preexisting nut when located in said operative position, said string clasp allowing said supplemental nut means to lift the string away from the preexisting nut when located in said inoperative position.

11. An apparatus for attachment to a stringed instrument, the instrument having a preexisting nut, a string whose pitch is controlled by an effective scale length of the string, a headstock, and a tuning peg, the apparatus comprising:

(a) supplemental nut means capable of being removably secured to the instrument, said supplemental nut means being capable of urging the string away from the preexisting nut, thereby increasing the effective scale length of the string;

(b) wherein said supplemental nut means includes (i) a base portion defining a foundational support of said supplemental nut means, said base portion being juxtaposed against the headstock of the instrument, (ii) a raised portion extending from said base portion, (iii) an alternative nut portion adjustably secured to said raised portion, said raised portion supporting and adjustably raising said alternative nut portion to a desired position, said alternative nut portion urging the string away from the preexisting nut and supporting the string at an increased effective scale length; and (c) means of adjustment, said adjustment means enabling said base portion to be moved laterally with respect to said raised portion, thereby enabling a position of said alternative nut portion to be adjusted with respect to the preexisting nut.

12. The apparatus of claim 11, wherein said adjustment means comprises a separable base portion and raised portion, said separable raised portion having a flange extending therefrom, said flange being juxtaposed against said base portion, said separable raised portion further having a threaded bore and a set screw, said set screw being threaded into said threaded bore and urged against said base portion.

13. A method for selectively increasing or shortening an effective scale length of a string of a stringed instrument, the instrument having a preexisting nut, a headstock, a tuning peg, and a tuning machine, said method comprising the steps of:

(a) removably securing a supplemental nut means to the tuning peg of the instrument in such a manner as to avoid modification and defacement of the headstock;

(b) adjusting a position of the supplemental nut means with respect too the tuning peg to selectively adjust the alignment and the effective scale length of the string;

(c) urging the string against the supplemental nut means, the supplemental nut means lifting the string away from the preexisting nut, thereby increasing the effective scale length of the string; and (d) selectively causing the string to contact or to not contact the preexisting nut by either forcing the string against the preexisting nut to negate the increased effective scale length or by allowing the string to assume an elevated position above the preexisting nut, respectively.

14. The method of claim 13, wherein said step of removably securing the supplemental nut means to the headstock further comprises the steps of:

(a) passing the tuning peg through a bore in a base portion of the supplemental nut means, the base portion defining a foundational support for the supplemental nut means, the supplemental nut means further comprising a raised portion extending from the base portion and an alternative nut portion adjustably secured to the raised portion;

(b) juxtaposing the base portion against the headstock of the instrument; and (c) securing the tuning peg to the tuning machine.

15. The method of claim 14, wherein said step of urging the string against the supplemental nut means further comprises the steps of:

(a) adjusting position of the supplemental nut means to proper alignment with longitudinal direction of the string;

(b) adjusting position of the alternative nut portion with respect to the raised portion, the base portion, and the headstock to urge and support the string away from the preexisting nut and to support the string at an increased effective scale length than would otherwise occur if the string were to contact the preexisting nut;

(c) urging the string against the alternative nut portion;

(d) securing the string to an appropriate tuning peg on the tuning machine; and (e) adjusting the tuning machine to increase tension within the string to obtain a desired pitch.

16. An apparatus for attachment to a stringed instrument, the instrument having a preexisting nut, a string whose pitch is controlled by an effective scale length of the string, a headstock, and a tuning peg, the apparatus comprising:

(a) supplemental nut means capable of being removably secured to the instrument, said supplemental nut means being capable of urging the string away from the preexisting nut, thereby increasing the effective scale length of the string;

(b) wherein said supplemental nut means includes (i) a base portion defining a foundational support of said supplemental nut means, said base portion being juxtaposed against the headstock of the instrument, (ii) a raised portion extending from said base portion, (iii) an alternative nut portion adjustably secured to said raised portion, said raised portion supporting and adjustably raising said alternative nut portion to a desired position, said alternative nut portion urging the string away from the preexisting nut and supporting the string at an increased effective scale length; and (c) wherein said base portion is provided with a bore through which the tuning peg may pass, the tuning peg securing said base portion against the headstock.

17. An apparatus for attachment to a stringed instrument, the instrument having a preexisting nut, a string whose pitch is controlled by an effective scale length of the string, a headstock, and a tuning peg, the apparatus comprising:

(a) supplemental nut means capable of being removably secured to the instrument, said supplemental nut means being capable of urging the string away from the preexisting nut, thereby increasing the effective scale length of the string;

(b) wherein said supplemental nut means includes (i) a base portion defining a foundational support of said supplemental nut means, said base portion being juxtaposed against the headstock of the instrument, (ii) a raised portion extending from said base portion, (iii) an alternative nut portion adjustably secured to said raised portion, said raised portion supporting and adjustably raising said alternative nut portion to a desired position, said alternative nut portion urging the string away from the preexisting nut and supporting the string at an increased effective scale length; and (c) wherein said raised portion is provided with a tunnel through which the string or another string may pass.

18. An apparatus for attachment to a stringed instrument, the instrument having a preexisting nut, a string whose pitch is controlled by an effective scale length of the string, a headstock, and a tuning peg, the apparatus comprising:

(a) supplemental nut means capable of being removably secured to the instrument, said supplemental nut means being capable of urging the string away from the preexisting nut, thereby increasing the effective scale length of the string;

(b) wherein said supplemental nut means includes (i) a base portion defining a foundational support of said supplemental nut means, said base portion being juxtaposed against the headstock of the instrument, (ii) a raised portion extending from said base portion, (iii) an alternative nut portion adjustably secured to said raised portion, said raised portion supporting and adjustably raising said alternative nut portion to a desired position, said alternative nut portion urging the string away from the preexisting nut and supporting the string at an increased effective scale length;

(c) wherein said alternative nut portion is provided with a channel within which the string is supported; and (d) wherein said alternative nut portion is provided with clamping means for securing the string supported within said channel against longitudinal movement therein.

19. The apparatus of claim 18, wherein said clamping means comprises a threaded wing-nut which engages a tapped bore formed within said alternative nut portion, said threaded wing-nut clamping the string against a bottom surface of said channel.

* * * * *